United States Patent [19]

Babbitt

[11] 4,179,795

[45] Dec. 25, 1979

[54] METHOD FOR FORMING A DRIVE HOLE IN ARC PLASMA SPRAY FABRICATED FERRITE PHASORS

[75] Inventor: Richard W. Babbitt, Fair Haven, N.J.

[73] Assignee: The United States of America as represented by the Secretary of the Army, Washington, D.C.

[21] Appl. No.: 915,638

[22] Filed: Jun. 15, 1978

[51] Int. Cl.[2] ..... H01F 41/02

[52] U.S. Cl. ..... 29/602 R; 29/423; 29/604; 264/317; 427/129; 427/130; 427/227; 427/289; 427/292

[58] Field of Search ..... 29/604, 602 R, 608, 29/423, 424; 427/129, 130, 131, 226, 227, 289, 292; 264/317

[56] References Cited

U.S. PATENT DOCUMENTS

| | | | |
|---|---|---|---|
| 2,988,804 | 6/1961 | Tibbetts | 264/317 X |
| 3,576,672 | 4/1971 | Harris et al. | 427/129 X |
| 3,747,176 | 7/1973 | Toyoshima | 29/424 X |

*Primary Examiner*—Carl E. Hall

*Attorney, Agent, or Firm*—Nathan Edelberg; Sheldon Kanars; Roy E. Gordon

[57] ABSTRACT

A method for forming a drive wire hole in a ferrite toroid phase shifter adapted to operate in the millimeter frequency range. The ferrite toroid is fabricated by the arc plasma spray process. A slab of boron nitride is initially bonded to the dielectric insert of the ferrite toroid and the ferrite powder is arc plasma sprayed on the composite boron nitride-dielectric structure. The formed ferrite toroid is then annealed, and during the annealing process, the boron nitride slab is completely sublimated to form the required drive wire hole.

14 Claims, 3 Drawing Figures

FIG. 1
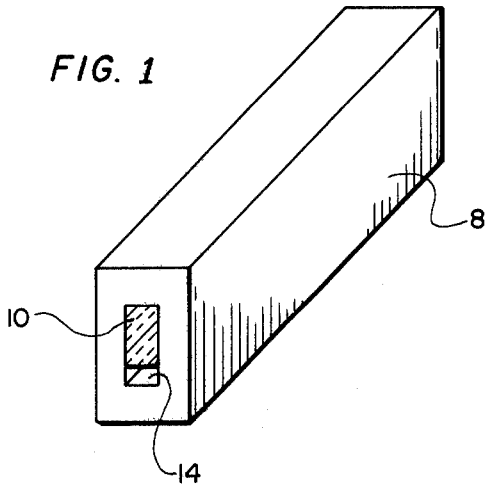
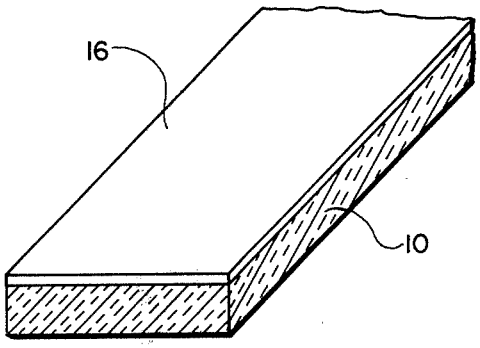
FIG. 2
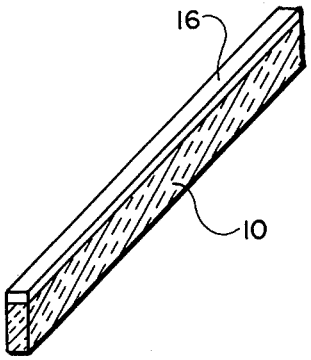
FIG. 3

METHOD FOR FORMING A DRIVE HOLE IN ARC PLASMA SPRAY FABRICATED FERRITE PHASORS

The invention described herein may be manufactured and used by or for Government for governmental purposes without the payment of any royalties thereon or therefor.

BACKGROUND OF THE INVENTION

This invention related to arc plasma spray fabricated ferrite toroids and more particularly to a novel method for producing an elongated drive wire hole through the toroid during the fabrication process.

Arc plasma spray techniques, hereinafter referred to as APS, for fabricating low cost, high performance, non-reciprocal, millimeter wave ferrite toroid phase shifters are well known in the art. By this technique, a ferrite powder, lithium ferrite powder for example, is deposited around a dielectric core or insert to produce the millimeter frequency ferrite toroid phasor. The APS process produces a bonded ferrite dielectric interface which enhances the performance characteristics of the phase shifter. The tolerance of the center of the ferrite toroid is exactly the dimension of the dielectric insert or core, while the outer dimension of the ferrite toroid is readily machined to within 0.001 inches. After machining, the APS fabricated ferrite toroid is annealed to reduce microwave losses and coercive forces. Heretofore, prior to the application of the ferrite powder, the dielectric core was sliced in half and each dielectric half was provided with identically positioned slots. The two halves were then placed together so that the opposing slots formed a longitudinal hole through which an appropriate drive wire was inserted. A ferrite powder can be arc plasma sprayed around the dielectric core without filling the hole so that the drive wire may be inserted through the hole after the formed ferrite has been machined and processed for proper operation at the desired frequency. However, it has been found that one disadvantage of using two dielectric halves is that the interface there between is a source for cracks in the ferrite phasor. Also, it is possible for the dielectric halves to slip prior to spraying, thereby producing improperly aligned interface walls which may deleteriously affect the performance characteristics of the ferrite. Another disadvantage in using two dielectric core halves is that during the fabrication or machining process, the two core halves may bow outwardly thereby forming an air gap which will also deleteriously affect the phasor performance. Moreover, the cost of a dielectric core using two halves is almost twice that of a solid dielectric core since twice the machining is required. The most significant disadvantage of utilizing the dielectric halves technique for forming drive wire holes is that APS formed ferrite toroid phasors can not be fabricated for frequencies higher than 16 GHz since, at these frequencies, the dielectric core is too thin, usually less than 0.02 inches, to work with halves. As the frequency of operation increases, the dielectric becomes thinner and therefore more difficult to work with.

BRIEF SUMMARY OF THE INVENTION

It is an object of the present invention to provide an improved technique for forming the drive wire aperture in APS fabricated ferrite toroid phase shifter wherein the aforementioned disadvantages are overcome.

It is another object of the present invention to provide an improved APS fabricated ferrite toroid phase shifter for operation at frequencies higher than 16 GHz.

In brief, the present invention is directed to a novel method of making a longitudinal hole for supporting a drive wire in a ferrite toroid fabricated in accordance with the arc plasma spray techniques. It comprises the steps of bonding a slab of boron nitride by epoxy cement on the longitudinal surface of a dielectric insert or core, arc plasma spraying a ferrite powder on the composite structure formed by the boron nitride and the dielectric insert and annealing the ferrite coated composite structure within a temperature range wherein only the boron nitride slab is completely sublimated to produce a drive wire hole within the ferrite toroid. The temperature range of the arc spray plasma process is chosen so that the boron nitride slab structure is not affected in any manner.

BRIEF DESCRIPTION OF THE DRAWINGS

FIG. 1 illustrates a conventional ferrite toroid with a drive wire hole; and FIGS. 2 and 3 illustrate the composite boron nitride and dielectric core structure.

DETAILED DESCRIPTION OF THE INVENTION

Referring now to FIG. 1 of the drawing, the conventional millimeter wave ferrite toroid phase shifter is shown as comprising a ferrite coating 8, a dielectric insert or core 10, and an elongated drive wire hole 14 for supporting the drive wire (not shown). FIGS. 2 and 3 show the type of composite structure required to carry out the present invention.

Referring now to FIG. 2 of the drawing, there is shown at 10, the rectangular dielectric insert or core having a prescribed thickness. Bonded to one wide surface of dielectric core 10 by a suitable epoxy cement is a boron nitride slab 16. As shown, the boron nitride slab 16 is much thinner than dielectric core 10. The integrated or composite structure of FIG. 2 may be sliced longitudinally parallel to the thickness dimension to provide relatively narrow composite structures of uniform thickness as shown in FIG. 3. The length and width of the narrow composite structure are a function of the desired operational frequency range. A suitable ferrite powder is arc plasma sprayed around the narrow composite structure of FIG. 3. The arc plasma spray technique is well known in the art and no further explanation thereof is believed necessary. Since the APS temperature range can be maintained below 400° C. and the sublimation temperature of boron nitride is between 600° C. and 1000° C., the epoxy bonded boron nitride slab 16 maintains its shape, dimensions and bond with dielectric core 10 during the time that the ferrite powder is being APS deposited on the composite structure. The usual spray time is about one minute and is applied at temperatures up to 400° C. As is well known in the art, after the ferrite powder deposition is completed, the coated structure must be annealed to enhance the magnetic properties of the newly formed ferrite toroid. The annealing temperature ranges between 950° C. and 1000° C., depending on the type of ferrite powder used. At these temperatures, the boron nitride slab 16 is completely sublimated to form an elongated hole in the ferrite toroid through which the drive wire is to be positioned. The thickness of boron nitride slab 16 is the thickness of the hole desired. Since the ferrite powder is APS deposited with a density greater than 90% of theoretical, there is no change in the ferrite toroid dimensions during the annealing process, and the hole produced is identical to the initial dimensions of the boron nitride slab 16.

The dielectric core 10 may comprise alumina, lithium titanate, or steatite. Although the dielectric constant is not critical, the dielectric material chosen must have a coefficient of expansion similar to the ferrite powder deposited by the APS process. Also, silicon nitride, graphite, or other suitable materials may be substituted for boron nitride, if desired, to form the high tolerance drive wire hole as described above.

While the invention has been described in connection with ferrite phase shifters, it is to be understood that the invention is not to be limited thereto. Boron nitride can be used for forming various geometeries for other ferrite and ceramic components. However, it is to be understood that the above described technique is not suitable for conventionally fired ceramic and ferrite components since at low firing temperatures ferrite and ceramics do not reach high densities. Thus, at higher temperatures required to sublime the boron nitride, the ferrite or ceramic will further densify thereby filling the void left by the sublimated boron nitride.

What is claimed is:

1. The method of making a drive wire hole in a ferrite toroid during the fabrication of said toroid wherein a ferrite powder is arc plasma spray deposited on a dielectric insert having a longitudinal surface, said method comprising the steps of:

bonding a slab of boron nitride on the longitudinal surface of the dielectric insert;

arc plasma spray depositing said ferrite powder on the composite structure of said slab of boron nitride bonded to the longitudinal surface of said dielectric insert within a temperature range wherein said boron nitride slab maintains its bond and original shape;

and annealing said composite structure of boron nitride bonded to the dielectric insert and bearing a coating of ferrite powder at temperatures wherein only said boron nitride slab is completely sublimated to form the drive wire hole.

2. The method in accordance with claim 1 wherein the ferrite powder is arc plasma spray deposited at a temperature below 400 degrees C.

3. The method in accordance with claim 1 wherein said annealing temperature varies between 950° C. and 1000° C.

4. The method in accordance with claim 2 wherein said annealing temperature range varies between 950° C. and 1000° C.

5. The method in accordance with claim 1 wherein said boron nitride slab is bonded to said dielectric insert with an epoxy cement.

6. The method in accordance with claim 5 wherein the ferrite powder is arc plasma spray deposited at a temperature below 400 degrees C.

7. The method in accordance with claim 5 wherein said annealing temperature range varies between 950° C. and 1000° C.

8. The method in accordance with claim 6 wherein said annealing temperature range varies between 950° C. and 1000° C.

9. The method in accordance with claim 1 wherein said dielectric insert comprises alumina.

10. The method in accordance with claim 1 wherein said dielectric insert comprises lithium titanate.

11. The method in accordance with claim 1 wherein said dielectric insert comprises steatite.

12. The method of making a drive wire hole in a ferrite toroid during the fabrication of said toroid wherein a ferrite powder is arc plasma spray deposited on a dielectric insert having a longitudinal surface, said method comprising the steps of:

bonding a slab of silicon nitride on the longitudinal surface of said dielectric insert;

arc plasma spray depositing said ferrite powder on the composite structure of said slab of silicon nitride bonded to the longitudinal surface of said dielectric insert within a temperature range wherein said silicon nitride slab maintains its bond and original shape;

and annealing said composite structure of silicon nitride bonded to the dielectric insert and bearing a coating of ferrite powder at temperatures wherein only said silicon nitride slab is completely sublimated to form the drive wire hole.

13. The method in accordance with claim 12 wherein the ferrite powder is arc plasma spray deposited at a temperature below 400 degrees C.

14. The method in accordance with claim 13 wherein said annealing temperature range varies between 950° C. and 1000° C.

* * * * *